US006964714B2

(12) United States Patent
Doll et al.

(10) Patent No.: US 6,964,714 B2
(45) **Date of Patent: *Nov. 15, 2005**

(54) REDUCED SENSITIVITY, MELT-POURABLE TRITONAL REPLACEMENTS

(75) Inventors: Daniel W. Doll, Ogden, UT (US); Jami M. Hanks, Logan, UT (US); Alan G. Allred, Brigham City, UT (US); John B. Niles, Lake Hopatacong, NJ (US)

(73) Assignees: Alliant Techsystems Inc., Edina, MN (US); The United States of America as represented by the Secretary of the Army, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/893,336

(22) Filed: Jun. 27, 2001

(65) Prior Publication Data

US 2003/0140993 A1 Jul. 31, 2003

(51) Int. Cl.[7] ..... C06B 45/06
(52) U.S. Cl. ..... 149/18
(58) Field of Search ..... 149/18, 105

(56) References Cited

U.S. PATENT DOCUMENTS

| | | | | | |
|---|---|---|---|---|---|
| 3,178,325 | A | | 4/1965 | Scott | |
| 3,379,585 | A | | 4/1968 | Miller et al. | |
| 3,574,298 | A | * | 4/1971 | Larson | 181/113 |
| 3,620,857 | A | * | 11/1971 | Soderberg et al. | 149/107 |
| 3,957,550 | A | | 5/1976 | Tannenbaum et al. | |
| 3,994,756 | A | | 11/1976 | Hendrickson, Sr. et al. | |
| 4,201,853 | A | * | 5/1980 | Henry et al. | 149/105 |
| 4,360,394 | A | * | 11/1982 | Portnoy | 149/105 |
| 4,600,452 | A | * | 7/1986 | Jessop et al. | 149/18 |
| 4,705,582 | A | * | 11/1987 | Aubert | 149/105 |
| 4,747,892 | A | | 5/1988 | Spencer | |
| 4,889,571 | A | | 12/1989 | Willer et al. | |
| 4,944,816 | A | | 7/1990 | Sayles | |
| 5,067,996 | A | | 11/1991 | Lundstrom et al. | |
| 5,302,763 | A | * | 4/1994 | Quakenbush | 568/934 |
| 5,358,587 | A | * | 10/1994 | Voigt, Jr. | 149/18 |
| 5,398,612 | A | | 3/1995 | Graham et al. | |
| 5,411,615 | A | | 5/1995 | Sumrail et al. | |
| 5,431,756 | A | * | 7/1995 | Kosowski et al. | 149/18 |
| 5,468,313 | A | | 11/1995 | Wallace, II et al. | |
| 5,500,060 | A | | 3/1996 | Holt et al. | |
| 5,529,649 | A | * | 6/1996 | Lund et al. | 149/105 |
| 5,552,000 | A | * | 9/1996 | Shepherd, Jr. | 149/105 |
| 5,587,553 | A | | 12/1996 | Braithwaite et al. | |
| 5,675,119 | A | | 10/1997 | Otani et al. | |
| 5,717,158 | A | * | 2/1998 | Capellos et al. | 149/18 |
| 5,728,969 | A | | 3/1998 | Otani et al. | |
| 5,949,016 | A | | 9/1999 | Baroody et al. | |
| 5,997,668 | A | | 12/1999 | Aubert et al. | |
| 6,425,966 | B1 | * | 7/2002 | Highsmith et al. | 149/19.1 |

FOREIGN PATENT DOCUMENTS

| | | |
|---|---|---|
| DE | 100 522 C | 6/1897 |
| DE | 12 21 945 B | 7/1966 |
| DE | 23 35 925 A | 2/1975 |
| DE | 37 44 680 A | 11/1991 |
| FR | 465 082 | 11/1913 |
| FR | 349 635 | 4/2004 |
| FR | 349 635 A | 4/2004 |
| GB | 1 605 421 | 11/1998 |
| WO | WO 98/49123 | 11/1998 |
| WO | WO 01/46092 | 6/2001 |

OTHER PUBLICATIONS

Chemical Abstracts, vol. 129, No. 18, Abstract No. 232724z, R.D. Chapman et al., A convenient correlation for prediction of binary eutectics involving organic explosives, p. 858 (XP00786346) (Nov. 2, 1998).

Joint Technical Bulletin, Navy document number NAVSEA INST 8020.8B, Air Force technical order 11A 1 47, Defense Logistics Agency regulation DLAR 8220.1, and Army technical bulletin TB700 2, Jan. 5, 1998, 99 pages.

* cited by examiner

*Primary Examiner*—Aileen Felton
(74) *Attorney, Agent, or Firm*—TraskBritt

(57) ABSTRACT

This melt-pourable explosive composition shares explosive properties comparable to those of Tritonal and is melt-pourable and castable under conditions comparable to those of Tritonal, but experiences equal or less impact, shock, and thermal sensitivity and avoids the issues of toxicity associated with trinitrotoluene. The trinitrotoluene component of Tritonal is replaced with one or more mononitro aromatic and/or dinitro aromatic melt-pourable binders, such as dinitroanisole, which can be melt poured without presenting the toxicity drawbacks experienced with the use of TNT. The melt-pourable binder can also be combined with a processing aid selected from the group consisting of alkylnitroanilines and arylnitroanilines. The composition also includes oxidizer particles, which are preferably inorganic oxidizer particles, and a reactive metallic fuel, such as aluminum.

35 Claims, No Drawings

REDUCED SENSITIVITY, MELT-POURABLE TRITONAL REPLACEMENTS

BACKGROUND OF THE INVENTION

1. Field of the Invention

This invention relates to explosives and, in particular, this invention relates to explosives that are melt-pourable and may function as excellent replacements for Tritonal. In a currently preferred aspect, this invention relates to Tritonal replacement compositions that exhibit similar melting characteristics, comparable energetic performance, and either comparable or reduced shock and thermal sensitivities to Tritonal. This invention also relates to mortars, grenades, artillery, warheads, and antipersonnel mines containing the melt-pourable Tritonal replacement compositions.

2. State of the Art

The melt-pourable explosive composition Tritonal usually consists of 60–80 weight percent 2,4,6-trinitrotoluene (TNT) and 20–40 weight percent aluminum (Al). Tritonal has been used in a wide array of military applications, although perhaps its most frequent use is as a general bomb fill. One of the reasons for the wide acceptance of Tritonal is that its binder component, TNT, has a relative low melting point of 81° C., which makes Tritonal suitable for pouring into shells or casings of munitions.

However, Tritonal has several drawbacks attributable to its TNT binder. One of the most prominent of these drawbacks is the toxicity of TNT. During synthesis of TNT, undesirable isomers are produced. Without wishing to be bound by any theory, it is believed that meta isomers produced during the nitration of toluene react with the sodium sulfite to produce water-soluble, sulfated nitrotoluene that is red and highly toxic. Waste streams containing these isomers are known as red and pink water and are considerably toxic and hazardous to workers and the environment. Consequently, stringent domestic environmental regulations have been imposed to protect worker safety and prevent against adverse ecological impact caused by the waste streams. However, waste stream cleanup is laborious and expensive. These regulations and safety precautions have also increased manufacturing costs and slowed production rates, thereby making Tritonal and TNT production largely uneconomical and leading to cessation of domestic TNT production by most, if not all, domestic manufacturers.

The generation of undesirable isomers during TNT synthesis has the additional drawback of increasing the exudation of TNT from the ordnance. Many isomers generated during TNT synthesis have melting points lower than that of TNT. These isomers tend to exude under high storage temperature requirements, such as about 74° C. (165° F.). The exudation of TNT isomers from Tritonal raises concerns that the isomers might enter into areas of munitions that are not designed for exposure to energetic materials. In such an event, the sensitivity, vulnerability, and ability to handle and transport the munitions safely may be compromised.

BRIEF SUMMARY OF THE INVENTION

Accordingly, the present invention provides a Tritonal replacement composition that exhibits comparable energetic and pouring properties to Tritonal, in particular, similar energies of detonation and melting points for melt-pouring procedures, but may be produced without as severe toxicity issues as encountered in TNT production and substantially without undesirable isomers that substantially lower the melting point of TNT and cause exudation.

The present invention also provides a Tritonal replacement that exhibits energetic and pouring properties comparable to Tritonal but increases process safety by exhibiting substantially reduced shock sensitivity and/or either comparable or reduced thermal sensitivity compared to Tritonal. For example, reduced sensitivity of the Tritonal replacement may mean a lower vulnerability to physical and thermal stimuli such as, for example, bullet and fragment impact, fast and slow cook-off, and/or sympathetic denotation.

In accordance with this invention as embodied and broadly described in this document, according to a first aspect of this invention, there is provided a melt-pourable explosive composition comprising 30 weight percent to 70 weight percent of one or more organic binders selected from the group consisting of mononitro aromatics and dinitro aromatics, 5 weight percent to 35 weight percent of one or more oxidizer, and 5 weight percent to 35 weight percent of one or more reactive metallic fuels. The aromatic binder or collection of aromatic binders exhibits an energy of detonation that is lower than TNT and collectively has a total melting point in a range of 80° C. to 115° C. The melt-pourable explosive composition is formulated to become melt-pourable at a temperature in a range of 80° C. to 115° C.

In accordance with a second aspect of this invention, a melt-pourable explosive composition comprises 30 weight percent to 70 weight percent of one or more organic binders selected from the group consisting of mononitro aromatics and dinitro aromatics, 5 weight percent to 35 weight percent of one or more inorganic oxidizers, and 5 weight percent to 35 weight percent of one or more reactive metallic fuels, preferably aluminum. The organic binder or collection of organic binders exhibits a total energy of detonation lower than TNT and collectively has a total melting point in a range of 80° C. to 115° C. The inorganic oxidizer(s) preferably comprise at least one member selected from the group consisting of perchlorates and nitrates and preferably have an average particle size of 3 to 60 microns, more preferably 5 to 20 microns. It is still more preferable that the mononitro/dinitro aromatic compound(s), the inorganic oxidizer(s), and the metallic fuel(s) collectively account for at least 95 weight percent, more preferably at least 99 weight percent of the total weight of the explosive composition. The composition is preferably essentially free of TNT. As in the case of the first aspect, in this second aspect, the melt-pourable explosive composition is formulated to become melt-pourable at a temperature in a range of 80° C. to 115° C.

In accordance with this invention, a fundamental and well-accepted component of Tritonal, 2,4,6-trinitrotoluene, is replaced with one or more aromatic binders, each preferably having one or two nitro groups, more preferably nitrocarbon ($C—NO_2$) moieties, and an oxidizer, preferably an inorganic oxidizer. It has been discovered that mononitro and dinitro aromatics such as dinitroanisole can be melt-poured without presenting the same degree of the toxicity drawbacks experienced with the use of TNT. Additionally, many mononitro and dinitro aromatics are lower in cost and more widely available than TNT. Mononitro and dinitro aromatics are less detonable than trinitrated aromatics. Therefore, the mononitro and dinitro aromatics do not require the explosive transportation, storage, and packaging infrastructure that trinitrated compounds, such as TNT, mandate.

Generally, the use of mononitro and dinitro aromatics in place of TNT in the Tritonal formulation has been disfavored (if not overlooked) in the melt-pouring art due to their low energetic oxygen content compared to TNT. This drawback is overcome by the addition of oxidizer particles to the melt-pourable Tritonal replacement composition. The oxidizer particles are preferably inorganic and preferably have relatively fine particle sizes. The oxidizer particles compensate for the energy loss experienced by the replacement of TNT with the less energetic mononitro and/or dinitro aromatic melt-pourable binders.

Additionally, the different melting points that mononitro and dinitro aromatics possess compared to TNT have also disfavored the melt-pourable binder substitution. Melt pouring requires heating of the binder to a temperature higher than its melting point, so that the binder can be mixed with the energetic filler, which is typically at ambient temperature, and poured by melting. A typical and useful melting point range for the melt or pour process is 80° C. to 115° C. However, melt-pourable Tritonal replacement compositions should not be heated close to or above their exothermic decomposition temperatures, because exothermic decomposition may cause the Tritonal replacement composition to ignite automatically and generate an exothermic deflagration or explosion. Preferably, a relatively wide "safety margin" is present between the melt temperature of the Tritonal replacement composition and the temperature at which the composition experiences an onset of exothermic decomposition. TNT has a melting point of about 80.9° C. and is believed to experience an onset of exothermic decomposition at about 185° C., giving a relatively wide safety margin between the binder melting temperature and the autoignition temperature. On the other hand, many mononitro and dinitro aromatics have melting points exceeding that of TNT, thereby narrowing the safety margin for melt pouring. For example, dinitroanisole has a melting point of 94° C.

This drawback can be overcome by adding a processing aid to the melt-pourable Tritonal replacement composition. The processing aid is preferably also a mononitro or dinitro aromatic and, more preferably, is selected from the group consisting of alkylnitroanilines and arylnitroanilines. The processing aid lowers the overall melting temperature of the energetic composition, preferably into a range of from 80° C. to 115° C., while preferably raising the onset of the exothermic decomposition temperature, preferably to at least 55° C. higher than the melting temperature to widen the safety margin.

This invention is also directed to ordnances and munitions in which the melt-pourable Tritonal replacement composition of this invention can be used, including, by way of example, mortars, grenades, artillery shells, warheads, and antipersonnel mines.

These and other objects, aspects and advantages of the invention will be apparent to those skilled in the art upon reading the specification and appended claims, which explain the principles of this invention.

DETAILED DESCRIPTION OF PREFERRED EMBODIMENTS AND METHODS OF THE INVENTION

Reference will now be made in detail to the presently preferred embodiments and methods of the invention. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification and appropriate equivalents.

It is to be noted that, as used in the specification and the appended claims, the singular forms "a," "an," and "the" include plural referents unless the context clearly dictates otherwise.

Generally, the melt-pourable binder or binders constitute 30 weight percent to 70 weight percent, more preferably 40 weight percent to 60 weight percent, of the total weight of the Tritonal replacement composition. It is preferred that the binder or binders include nitrocarbon (C—$NO_2$) moieties, although the nitro moieties may include nitramines (N—$NO_2$). Exemplary melt-pourable binders suitable for this invention include mononitro-substituted and dinitro-substituted phenyl alkyl ethers having the following formula:

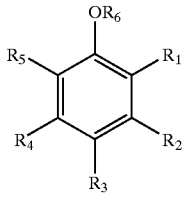

wherein one or two members selected from $R_1$, $R_2$, $R_3$, $R_4$, and $R_5$ are nitro (—$NO_2$) groups, the remaining of $R_1$ to $R_5$ are the same or different and are preferably selected from —H, —OH, —$NH_2$, $NR_7R_8$, an aryl group, or an -alkyl group (such as methyl), $R_6$ is an alkyl group (preferably a methyl, ethyl, or propyl group), $R_7$ is hydrogen or an alkyl or aryl group, and $R_8$ is hydrogen or an alkyl group.

2,4-dinitroanisole (2,4-dinitrophenyl-methyl-ether) and 2,4-dinitrophenetole (2,4-dinitrophenyl-ethyl-ether) are examples of dinitro-substituted phenyl alkyl ethers suitable for use in the present melt-pourable explosive composition, while 4-methoxy-2-nitrophenol is an example of a preferred mononitro-substituted phenyl alkyl ether.

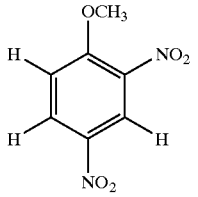

2,4-dinitroanisole (DNAN)

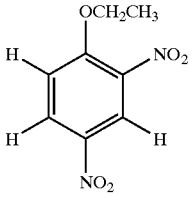

2,4-dinitrophenotole

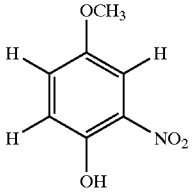

4-methoxy-2-nitrophenol

As referred to herein, aromatics include phenols and aryl amines. For example, mononitro and dinitro aromatic binders suitable for use with this invention include nitrophenols, such as meta-nitrophenol, para-nitrophenol, and 2-amino-4-nitrophenol; dinitrophenols, such as 2,4-dinitrophenol and 4,6-dinitro-o-cresol; nitrotoluene and dinitrotoluenes, such as 2,4-dinitrotoluene; mononitroanilines, such as ortho-nitroaniline, meta-nitroaniline, and para-nitroaniline; and dinitroanilines, such as 2,4-dinitroaniline and 2,6-dinitroaniline. As referred to herein, aromatics also include polycyclic benzenoid aromatics, such as mononitronaphthalenes and dinitronaphthalenes (e.g., 1,5-dinitronapthalene). It is also within the scope of the invention to use one or more heterocyclic binders, such as 4-chloro-7-nitrobenzofurazon, 5-nitro-2-furaldehyde diacetate, 5-nitro-isoquinoline, and methyl-5-nitro-2-furoate.

Other mononitro and dinitro aromatic binders that maybe considered include the following:

4-nitrobenzaldehyde;
4-nitroacetophenone;
2-nitrobenzonitrile;
3-nitrobenzophenone;
4-nitrobenzyl alcohol;
4-nitrobenzyl bromide;
5-nitroisoquinoline;
4-nitrophenyl acetate,
2-nitrophenyl acetonitrile;
3-nitrophenyldisulfide;
4-nitrophenyl chloroformate;
1-(2-nitrophenyl)-1,2-ethanoldiol;
4-nitrophenyl trimethylacetate;
8-nitroquinoline;
2-nitro-4-(trifluoromethyl)aniline;
4-chloro-3-nitroacetophenone;
methyl-3-hydroxy-4-nitrobenzoate;
methyl-3-nitrobenzoate;
methyl-4-nitrobenzo ate;
2-methyl-5-nitrobenzonitrile; and
3-methyl-4-nitrobenzonitrile.

The above examples of representative binders are not meant to be exhaustive. Rather, other aromatic binders may be suitable for this invention. Suitability of the binder is determined by balancing of various features and binder characteristics. For example, the binder preferably can be characterized by several or all of the following attributes: nontoxic, nonhygroscopic, nonmutagenic, light insensitive, air insensitive, noncorrosive, not a lachrymator, moisture insensitive, temperature insensitive between −54° C. and 140° C., melting point between 80° C. and 115° C., and viscosity of lower than 0.64 kp (kilopoise), more preferably than 0.16 kp within the pour temperature range of 80° C. to 115° C.

The mononitro and dinitro aromatics generally have a much lower toxicity than TNT, particularly when the aromatics do not contain —OH and/or —$NH_2$ functionalities. Thus, in many instances, the use of mononitro and dinitro aromatics often simplifies handling and reduces the costs associated with manufacturing the Tritonal replacement explosive.

The processing aid of this invention preferably is a mononitro or dinitro aromatic and, more preferably, is one or more N-alkyl-nitroanilines and/or N-aryl-nitroanilines having the following formula:

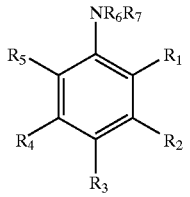

wherein $R_6$ is hydrogen, $R_7$ is an unsubstituted or substituted hydrocarbon (e.g., straight-chain alkyl, branched alkyl, cyclic alkyl, or aryl group), at least one of $R_1$ to $R_5$ is a nitro group, the remaining of $R_1$ to $R_5$ are the same or different and are preferably selected from —H, —OH, —$NH_2$, $NR_8R_9$, an aryl group, or an -alkyl group (such as methyl), $R_8$ is hydrogen or an alkyl or aryl group, and $R_9$ is hydrogen or an alkyl group. Exemplary N-alkyl nitroaniline processing aids include the following:

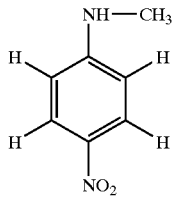

N-methyl-p-nitroaniline (MNA)

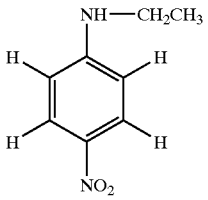

N-ethyl-p-nitroaniline

Examples of aryl-nitroaniline processing aids include the following:

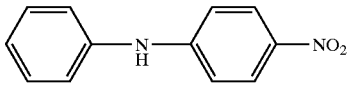

4-nitrodiphenylamine

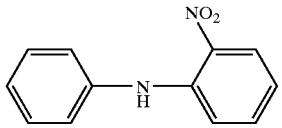

2-nitrodiphenylamine

The concentration of the processing aid is selected in order to widen the "safety margin" at which the melt-pourable Tritonal replacement composition can be melt poured without significant threat of an onset of exothermic decomposition and auto-ignition of the Tritonal replacement composition. The processing aid preferably acts to lower the melting point of the composition towards (but not necessarily to) its eutectic point. By controlling the amount of the processing aid, the melting point of the mixture of binder and processing aid can be adjusted into a range of 80° C. to 110° C. that generally characterizes melt-pourable materials. More preferably, the melting point is adjusted to 80° C. to 110° C., more preferably 80° C. to 90° C. Simultaneously, the processing aid preferably raises the temperature at which the composition experiences an onset of exothermic decomposition, thereby widening the safety margin between the melting temperature and the auto-ignition temperature of the Tritonal replacement composition.

The concentration of the processing aid can be selected by taking into account the amount of melt-pourable binder in the overall melt-pourable Tritonal replacement composition, the purity of the binder, and the nitrogen content of the binder. Generally, the Tritonal replacement composition can include, for example, from about 0.15 weight percent to about 1 weight percent processing aid based on the total weight of the Tritonal replacement composition. Using more than about 1 weight percent of the processing aid may lower the pour temperature of the melt-pourable Tritonal replacement composition to below about 80° C.

Representative inorganic oxidizers suitable for the present melt-pourable Tritonal replacement composition include perchlorates, such as potassium perchlorate, sodium perchlorate, strontium perchlorate, and ammonium perchlorate; and nitrates, such as potassium nitrate, sodium nitrate, strontium nitrate, ammonium nitrate, copper nitrate ($Cu_2$ $(OH)_3NO_3$), and hydroxylammonium nitrate (HAN); ammonium dinitramide (ADN); and hydrazinium nitroformate (HNF). Organic oxidizers having excess amounts of oxygen available for oxidizing the binder can also be used, although preferably the oxidizers consist of inorganic compounds. Examples of suitable organic oxidizers include nitramines, such as CL-20. In the event an organic oxidizer is used in the melt-pourable explosive composition, the organic oxidizer is preferably present in less than 20 weight percent, more preferably less than 10 weight percent, still more preferably less than 5 weight percent, and most preferably no more than 1 weight percent based on the total weight of the explosive composition.

The oxidizer particles preferably have particle diameters of, on average, 3 to 60 microns, more preferably 5 to 20 microns. It is possible to use bimodal distributions, such as a combination of coarse particles (200 to 400 microns) and fine particles (less than 20 microns). More preferred, however, is a single modal distribution of 5 to 50 microns. In the event that a single modal distribution in this particle size range is selected, the content of inorganic oxidizer in the energetic composition is preferably in a range of 15 weight percent to 20 weight percent.

Representative reactive metallic fuels that may be used in this invention include one or more of the following: aluminum, magnesium, boron, titanium, zirconium, and mixtures thereof. Of these, aluminum is preferred. The particles may have an average particle size of, for example, 3 to 60 microns and, more preferably, 5 to 20 microns. The metallic fuel preferably constitutes from 5 weight percent to 35 weight percent of the Tritonal replacement composition and, more preferably, 15 weight percent to 20 weight percent. Preferably, the inorganic oxidizer and metallic fuel are present in a weight ratio of about 1:1.

Preferably, the melt-pourable Tritonal replacement composition of this invention is substantially free of polymeric binders conventionally found in pressable and extrudable energetic materials, since an undue amount of these polymeric binders can lower the energy (especially for nonenergetic polymer binders) and reduce the melt pourability (by increasing the viscosity) of the melt-pourable explosive.

A process of making the melt-pourable Tritonal replacement composition will now be described in more detail below. It should be understood that various modifications and alterations to the process and equipment described below are possible and encompassed by this invention.

The binder and optional processing aid are loaded into a pressurized, steam-heated melt kettle having a surrounding jacket. The kettle is heated to a temperature far enough above the melting temperature of the binder and processing aid to prevent solidification of the binder during the subsequent addition of ambient-temperature particles, but not so high as to cause an onset of exothermic decomposition. For example, the kettle may be heated to about 90° C. to 100° C., preferably 95° C. The oxidizer and fuel are then added by metering, i.e., adding the oxidizer and fuel either in stages or continuously so as not to lower the temperature of the melt phase below its melting temperature. Preferably, the oxidizer is added prior to the fuel. Constant stirring is preferably performed throughout the mix cycle. Stirring is preferably sufficiently rapid to wet the oxidizer particles and achieve homogeneity in a relatively short time period. The mixture is then poured or cast, usually into a case of munitions or the like.

As mentioned above, the melt-pourable composition of preferred aspects of this invention exhibits comparable energetic and pouring properties to Tritonal but increases process safety by exhibiting substantially reduced shock sensitivity compared to Tritonal.

An indicator of thermal stability is the temperature at which an explosive composition experiences an exotherm, or exothermic decomposition. A test known as Stimulated Bulk Autoignition Test, or SBAT, may be used to determine this temperature. Essentially, the SBAT simulates the thermal response of a large mass of energetic material using only a small quantity of material. The test sample is placed in a Pyrex tube and insulated, and then placed in metal blocks in an oven. An identically insulated nonreactive sample, such as an aluminum block, is placed in the oven alongside of the test sample for temperature comparisons. The samples are heated from 38° C. (100° F.) to 260° C. (500° F.) over a 16 hour period at a rate of 13.3° C./hr (24° F./hr). The temperatures of the energetic material and control are monitored through thermocouples and recorded on a chart until the test is complete. The reaction is recorded along with the onset temperature, which is the temperature at which the data trace of the energetic material first leaves the baseline, i.e., that of the control.

Energetic materials with high autoignition temperatures are desirable because they are less likely to explode or detonate when exposed to elevated temperatures. The energetic composition of this invention preferably experiences an onset of thermal decomposition that is at least 55° C., more preferably at least 100° C., higher than the temperature at which the energetic composition becomes melt-pourable.

One test for measuring shock sensitivity is known in the art as the Large Scale Gap Test (LSGT), in which a test material is placed into a metal tube on top of a witness plate. A predetermined number of PMMA (polymethylmethacrylate) cards are placed between the top of the metal tube and a booster material, which typically consists of 50 wt % PETN (pentaerythritol tetranitrate) and 50 wt % TNT (trinitrotoluene), available as Pentolite. The distance between the booster and the metal tube is expressed in cards, where 1 card is equal to 0.0254 cm (0.01 inch), such that 100 cards equal 2.54 cm (1 inch). A card gap measurement is the minimum number of cards required to prevent the booster from detonating the explosive sample, so that the sample does not blow a hole through the witness plate. Thus, the lower the card value, the lower the shock sensitivity.

The LSGT (or NOL Card Pipe Test) is more fully described in Joint Technical Bulletin, Navy document number NAVSEA INST 8020.8B, Air Force technical order 11A-1-47, Defense Logistics Agency regulation DLAR 8220.1, and Army technical bulletin TB700-2.

Tritonal has a measured card gap value of 127. The explosive composition of this invention preferably has a card gap value that is less than 127, more preferably less than 105, and still more preferably less than 85.

Energetic performance of an explosive can be evaluated through use of calculated properties, such as total energy of detonation, theoretical maximum density (TMD), detonation pressure, shock velocity, cylinder expansion energy, and the like. These properties may be calculated based on the software CHEETAH, available through Lawrence Livermore National Laboratory of Livermore, Calif. This software is well known and used in the art, including by those having ordinary skill in the art of explosive development.

Tritonal has a total energy of detonation of 12.9 kJ/cc. In an especially preferred embodiment of this invention, the melt-pourable explosive composition has a total energy of detonation within 10 percent of 12.9 kJ/cc, i.e., 11.6 kJ/cc to 14.2 kJ/cc.

A measurable property for determining energetic performance of an explosive is dent depth. Dent depth measurements are conducted by placing a 350 gram sample in a metal tube, identical to the one discussed above and used for the NOL card gap test, having exposed ends. The metal tube sits on a 1018 steel plate having a thickness of 5.08 cm (2 inches) and a width and height of 15.24×15.24 cm (6×6 inches), so that one of the ends of the tube is in contact with the steel plate. A Pentolite booster is placed on top of the metal tube and in operative association with the sample. The explosive is detonated in the pipe by activating the booster. The detonation products from the explosion form an indentation in the steel plate. The depth of this indentation is measured and recorded as the dent depth, which represents the amount of work performed by the explosive.

The dent depth of Tritonal is about 0.793 cm (0.312 inch). The dent depth of the explosive composition of this invention is preferably within 10 percent of that of Tritonal, i.e., 0.713 cm to 0.872 cm.

EXAMPLES

The following examples illustrate embodiments that have been made in accordance with the present invention. Also set forth are comparative examples prepared for comparison purposes. The inventive embodiments are not exhaustive or exclusive but merely representative of the invention.

Unless otherwise indicated, all parts are by weight.

Example 1

In a pressurized, steam-heated melt kettle, dinitroanisole (DNAN) and N-methyl-p-nitroaniline (MNA) were introduced and heated above their melting temperatures and stirred until melted and homogeneous. Fifty micron particles of ammonium perchlorate and then 3 micron particles of aluminum were metered into the kettle while maintaining constant stirring. The explosive composition was then melt poured onto a flaker, cooled at room temperature, and then broken into small flake-like solid pieces, nominally 0.64 cm (0.25 inch) thick by 1.27×1.27 cm (0.5×0.5 inch). The flakes were then remelted in the melt kettle and poured into the ordnance. The explosive composition comprised 49.75 weight percent DNAN, 0.25 weight percent MNA, 30 weight percent ammonium perchlorate, and 20 weight percent aluminum. When tested, the composition exhibited a dent depth of 0.808 cm, a card gap of less than 90, and an exotherm of 207° C.

Example 2

In a pressurized, steam-heated melt kettle, dinitroanisole (DNAN) and N-methyl-p-nitroaniline (MNA) were introduced and heated above their melting temperatures and stirred until melted and homogeneous. Nine micron particles of ammonium perchlorate and 3 micron particles of aluminum were sequentially metered into the kettle while maintaining constant stirring. The explosive composition was then melt poured onto a flaker, cooled at room temperature, and then broken into small flake-like solid pieces, nominally 0.64 cm (0.25 inch) thick by 1.27×1.27 cm (0.5×0.5 inch). The explosive composition comprised 49.75 weight percent DNAN, 0.25 weight percent MNA, 30 weight percent ammonium perchlorate, and 20 weight percent. When tested, the composition exhibited a dent depth of 0.876 cm, a card gap of 40, and an exotherm of 209° C.

Example 3

100481 In a pressurized, steam-heated melt kettle, dinitroanisole (DNAN) and N-methyl-p-nitroaniline (MNA) were introduced and heated above their melting temperatures and stirred until melted and homogeneous. Fifty micron particles of ammonium perchlorate and 20 micron particles of aluminum were metered into the kettle while maintaining constant stirring. The explosive composition was then melt poured onto a flaker, cooled at room temperature, and then broken into small flake-like solid pieces, nominally 0.64 cm (0.25 inch) thick by 1.27×1.27 cm (0.5×0.5 inch). The explosive composition comprised 49.75 weight percent DNAN, 0.25 weight percent MNA, 30 weight percent ammonium perchlorate, and 20 weight percent aluminum. When tested, the composition exhibited a dent depth of 0.785 cm, a card gap of 58, and an exotherm of 218° C.

Example 4

In a pressurized, steam-heated melt kettle, dinitroanisole (DNAN) and N-methyl-p-nitroaniline (MNA) were introduced and heated above their melting temperatures and stirred until melted and homogeneous. Nine micron particles of ammonium perchlorate and 20 micron particles of aluminum were metered into the kettle while maintaining constant stirring. The explosive composition was then melt poured onto a flaker, cooled at room temperature, and then broken into small flake-like solid pieces, nominally 0.64 cm (0.25 inch) thick by 1.27×1.27 cm (0.5×0.5 inch). The explosive composition comprised 49.75 weight percent DNAN, 0.25 weight percent MNA, 30 weight percent ammonium perchlorate, and 20 weight percent aluminum. When tested, the composition exhibited a dent depth of 0.84 cm, a card gap of 60, and an exotherm of 218° C.

Example 5

In a pressurized, steam-heated melt kettle, dinitroanisole (DNAN) and N-methyl-p-nitroaniline (MNA) were introduced and heated above their melting temperatures and stirred until melted and homogeneous. Fifty micron particles of ammonium perchlorate and 3 micron particles of aluminum were metered into the kettle while maintaining constant stirring. The explosive composition was then melt poured onto a flaker, cooled at room temperature, and then broken into small flake-like solid pieces, nominally 0.64 cm (0.25 inch) thick by 1.27×1.27 cm (0.5×0.5 inch). The explosive composition comprised 59.75 weight percent DNAN, 0.25 weight percent MNA, 17 weight percent ammonium perchlorate, and 23 weight percent aluminum. When tested, the composition exhibited a dent depth of 0.792 cm, a card gap of less than 50, and an exotherm of 242° C.

Example 6

In a pressurized, steam-heated melt kettle, dinitroanisole (DNAN) and N-methyl-p-nitroaniline (MNA) were introduced and heated above their melting temperatures and stirred until melted and homogeneous. Fifty micron particles of ammonium perchlorate and 20 micron particles of aluminum were sequentially metered into the kettle while maintaining constant stirring. The explosive composition was then melt poured onto a flaker, cooled at room temperature, and then broken into small flake-like solid pieces, nominally 0.64 cm (0.25 inch) thick by 1.27×1.27 cm (0.5×0.5 inch). The explosive composition comprised 59.75 weight percent DNAN, 0.25 weight percent MNA, 17 weight percent ammonium perchlorate, and 23 weight percent aluminum. When tested, the composition exhibited a dent depth of 0.747 cm, a card gap of 69, and an exotherm of 204° C.

Each of Examples 1 and 3–6 exhibited dent depths falling within 10 percent of the dent depth of Tritonal. Example 2 was outside the range by a negligible amount of 0.004 cm. Examples 1–6 also exhibited card gaps well below that of Tritonal.

The foregoing detailed description of the preferred embodiments of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A melt-pourable explosive composition comprising:

30 weight percent to 70 weight percent of an organic binder comprising 2,4-dinitroanisole, 5 weight percent to 35 weight percent of at least one oxidizer; and 5 weight percent to 35 weight percent of at least one reactive metallic fuel, wherein the melt-pourable explosive composition is pourable at a temperature in a range of 80° C. to 115° C.

2. The melt-pourable explosive composition of claim 1, further comprising an N-alkyl-nitroaniline processing aid.

3. The melt-pourable explosive composition of claim 1, further comprising N-methyl-nitroaniline as a processing aid.

4. The melt-pourable explosive composition of claim 1, further comprising at least one processing aid selected from the group consisting of N-alkyl nitroaniline and N-aryl-nitroaniline, the at least one processing aid accounting for not more than 1 weight percent of the melt-pourable explosive composition.

5. The melt-pourable explosive composition of claim 1, wherein the at least one reactive metallic fuel comprises aluminum.

6. The melt-pourable explosive composition of claim 1, wherein the melt-pourable explosive composition undergoes an onset of thermal decomposition at a temperature that is at least 55.5° C. higher than the temperature at which the melt-pourable explosive composition becomes pourable.

7. The melt-pourable explosive composition of claim 1, wherein the melt-pourable explosive composition exhibits a card gap value of less than 105.

8. The melt-pourable explosive composition of claim 1, wherein the melt-pourable explosive composition exhibits a card gap value of less than 85.

9. The melt-pourable explosive composition of claim 1, wherein the melt-pourable explosive composition has a total energy of detonation of 11.6 kJ/cc to 14.2 kg/cc.

10. A melt-pourable explosive composition comprising:

30 weight percent to 70 weight percent of an organic binder comprising 2,4-dinitroanisole;

5 weight percent to 35 weight percent of at least one inorganic oxidizer; and 5 weight percent to 35 weight percent of at least one reactive metallic fuel;

wherein the melt-pourable explosive composition is pourable at a temperature in a range of 80° C. to 115° C.

11. The melt-pourable explosive composition of claim 10, further comprising an N-alkyl-nitroaniline processing aid.

12. The melt-pourable explosive composition of claim 10, further comprising N-methyl-nitroaniline as a processing aid.

13. The melt-pourable explosive composition of claim 10, wherein the organic binder further comprises an N-aryl-nitroaniline.

14. The melt-pourable explosive composition of claim 10, further comprising at least one processing aid selected from the group consisting of N-alkyl nitroaniline and N-aryl-nitroaniline, the at least one processing aid accounting for not more than 1 weight percent of the melt-pourable explosive composition.

15. The melt-pourable explosive composition of claim 10, wherein the at least one inorganic oxidizer comprises at least one member selected from the group consisting of perchlorates and nitrates.

16. The melt-pourable explosive composition of claim 10, wherein the at least one inorganic oxidizer comprises at least one perchlorate selected from the group consisting of ammonium perchlorate, sodium perchlorate, and potassium perchlorate.

17. The melt-pourable explosive composition of claim 10, wherein the one or more inorganic oxidizers comprise at least one nitrate selected from the group consisting of ammonium nitrate, sodium nitrate, strontium nitrate, and potassium nitrate.

18. The melt-pourable explosive composition of claim 10, wherein the at least one inorganic oxidizer has an average particle size of 3 microns to 60 microns.

19. The melt-pourable explosive composition of claim 10, wherein the at least one inorganic oxidizer has an average particle size of 5 microns to 20 microns.

20. The melt-pourable explosive composition of claim 10, wherein at least 95 weight percent of the melt-pourable explosive composition comprises a combination of the organic binder, at least one inorganic oxidizer, and at least one reactive metallic fuel.

21. The melt-pourable explosive composition of claim 10, wherein at least 99 weight percent of the melt-pourable explosive composition comprises a combination of the organic binder, the at least one inorganic oxidizer, and at least one reactive metallic fuel.

22. The melt-pourable explosive composition of claim 10, wherein the at least one reactive metallic fuel comprises aluminum.

23. The melt-pourable explosive composition of claim 10, wherein the melt-pourable explosive composition undergoes an onset of thermal decomposition at a temperature that is at least 55.5° C. higher than the temperature at which the melt-pourable explosive composition becomes pourable.

24. The melt-pourable explosive composition of claim 10, wherein the melt-pourable explosive composition exhibits a card gap value of less than 105.

25. The melt-pourable explosive composition of claim 10, wherein the melt-pourable explosive composition exhibits a card gap value of less than 85.

26. The melt-pourable explosive composition of claim 10, wherein the melt-pourable explosive composition exhibits a dent depth in a range of 0.713 cm to 0.872 cm.

27. The melt-pourable explosive composition of claim 10, wherein the melt-pourable explosive composition has a total energy of detonation of 11.6 kJ/cc to 14.2 kg/cc.

28. A melt-pourable explosive composition comprising:

30 weight percent to 70 weight percent of an organic binder comprising 2,4-dinitroanisole, 5 weight percent to 35 weight percent of at least one inorganic oxidizer; and weight percent to 35 weight percent of at least one reactive metallic fuel;

wherein the melt-pourable explosive composition is melt-pourable at a temperature in a range of 80° C. to 115° C., undergoes an onset of thermal decomposition at a temperature that is at least 55.5° C. higher than the temperature at which the melt-pourable explosive composition becomes pourable, and exhibits a card gap value of less than 105, a dent depth in a range of 0.713 cm to 0.872 cm, and a total energy of detonation of 11.6 kJ/cc to 14.2 kJ/cc.

29. The melt-pourable explosive composition of claim 28, wherein the card gap value exhibited by the melt-pourable explosive composition is less than 85.

30. The melt-pourable explosive composition of claim 1, wherein the at least one oxidizer comprises an inorganic oxidizer present in the melt-pourable explosive composition in a single modal particle size distribution in a range of 5 microns to 50 microns, the inorganic oxidizer constituting from 15 weight percent to 20 weight percent of the melt-pourable explosive composition.

31. The melt-pourable explosive composition of claim 10, wherein the at least one inorganic oxidizer is present in the melt-pourable explosive composition in a single modal particle size distribution in a range of 5 microns to 50 microns, the at least one inorganic oxidizer constituting from 15 weight percent to 20 weight percent of the melt-pourable explosive composition.

32. The melt-pourable explosive composition of claim 28, wherein the at least one inorganic oxidizer comprises an inorganic oxidizer present in the melt-pourable explosive composition in a single modal particle size distribution in a range of 5 microns to 50 microns, the inorganic oxidizer constituting from 15 weight percent to 20 weight percent of the melt-pourable explosive composition.

33. The melt-pourable explosive composition of claim 1, wherein the at least one oxidizer comprises ammonium perchlorate.

34. The melt-pourable explosive composition of claim 10, wherein the at least one inorganic oxidizer comprises ammonium perchlorate.

35. The melt-pourable explosive composition of claim 28, wherein the at least one inorganic oxidizer comprises ammonium perchlorate.

* * * * *

UNITED STATES PATENT AND TRADEMARK OFFICE

CERTIFICATE OF CORRECTION

PATENT NO. : 6,964,714 B2
APPLICATION NO. : 09/893336
DATED : November 15, 2005
INVENTOR(S) : Daniel W. Doll et al.

It is certified that error appears in the above-identified patent and that said Letters Patent is hereby corrected as shown below:

In the specification:

| | | |
|---|---|---|
| COLUMN 5, | LINE 27, | change "nitrobenzo ate;" to --nitrobenzoate;-- |
| COLUMN 5, | LINES 40,41 | change "preferably than" to --preferably lower than-- |
| COLUMN 6, | LINE 43, | change "110° C." to --115° C.-- |
| COLUMN 9, | LINE 60, | change "20 weight percent." to --20 weight percent aluminum.-- |
| COLUMN 9, | LINE 66, | at the beginning of the line delete "100481" |

In the claims:

| | | | |
|---|---|---|---|
| CLAIM 20, | COLUMN 12, | LINES 35,36 | change "and at least one reactive metallic fuel." to --and the at least one reactive metallic fuel.-- |
| CLAIM 21, | COLUMN 12, | LINES 40,41 | change "and at least one reactive metallic fuel." to --and the at least one reactive metallic fuel.-- |
| CLAIM 28, | COLUMN 12, | LINE 65, | change "2,4-dinitroanisole," to --2,4-dinitroanisole;-- |

Signed and Sealed this

Twenty-seventh Day of January, 2009

John Doll

JOHN DOLL
*Acting Director of the United States Patent and Trademark Office*